US007128070B2

(12) United States Patent
Wiener et al.

(10) Patent No.: US 7,128,070 B2
(45) Date of Patent: Oct. 31, 2006

(54) BIOLOGICAL DEFENSE MASKS

(76) Inventors: Stanley L. Wiener, 631 Alexandria Dr., Naperville, IL (US) 60565; Corey Grove, 1040 Woodridge Rd., Red Lion, PA (US) 17356

( * ) Notice: Subject to any disclaimer, the term of this patent is extended or adjusted under 35 U.S.C. 154(b) by 564 days.

(21) Appl. No.: 10/316,474

(22) Filed: Dec. 11, 2002

(65) Prior Publication Data

US 2004/0011363 A1 Jan. 22, 2004

Related U.S. Application Data

(60) Provisional application No. 60/340,468, filed on Dec. 12, 2001.

(51) Int. Cl.
*A62B 7/10* (2006.01)
*A62B 18/08* (2006.01)

(52) U.S. Cl. ..... 128/206.12; 128/206.21; 128/201.15; 128/201.25; 2/206

(58) Field of Classification Search ..... None
See application file for complete search history.

(56) References Cited

U.S. PATENT DOCUMENTS

| | | | | |
|---|---|---|---|---|
| 3,227,159 | A * | 1/1966 | Alcibiade et al. | 128/201.15 |
| 4,901,370 | A * | 2/1990 | Suda | 2/457 |
| 5,297,544 | A * | 3/1994 | May et al. | 128/202.22 |
| 5,406,944 | A * | 4/1995 | Gazzara | 128/206.19 |
| 6,158,429 | A * | 12/2000 | Gardner et al. | 128/201.25 |
| 6,763,835 | B1 * | 7/2004 | Grove et al. | 128/857 |

* cited by examiner

*Primary Examiner*—Glenn K. Dawson
(74) *Attorney, Agent, or Firm*—Fitch, Even, Tabin & Flannery

(57) ABSTRACT

The invention relates to biological defense masks, and more particularly, biological defense masks designed for use by populations at risk of widespread biological attack via biological weapons of mass destruction. The present invention is also related to methods for using such biological defense masks wherein meteorological data is used to issue advisories with regard to the use of such biological defense masks to a population at risk of biological weapons of mass destruction.

7 Claims, 4 Drawing Sheets

BIOLOGICAL DEFENSE MASKS

RELATED APPLICATION

This application is based on, and claims benefit of, U.S. Provisional Application Ser. No. 60/340,468, filed on Dec. 12, 2001, and which is hereby incorporated by reference.

FIELD OF THE INVENTION

The invention relates to biological defense masks, and more particularly, biological defense masks designed for use by populations at risk of widespread biological attack via biological weapons of mass destruction, especially biological weapons involving aerosol attacks. The present invention is also related to methods for using such biological defense masks wherein meteorological data is used to issue advisories with regard to the use of such biological defense masks to a population at risk of exposure to biological weapons of mass destruction.

BACKGROUND OF THE INVENTION

The tragic events of Sep. 11, 2001, and the anthrax exposure cases thereafter clearly demonstrated the risks of terrorist attacks on civilian populations anywhere in the world using weapons of mass destruction. Biological weapons pose a significant threat to such civilian populations. Although the anthrax exposure shortly after September 11 appears to be almost exclusively through contact with contaminated mail, these events highlight the potential risk from such biological agents. A likely mode of delivery of highly infectious or toxic agents is by atmospheric release since potentially large populations could be exposed in a relatively short time. Aerosol particles in the range of about 0.3 to about 15 microns in diameter could be delivered by rockets, bomblets with aerosol nozzles, missiles, aircraft equipped with tanks and spray nozzles (e.g., crop dusting aircraft, helicopters, and the like), small boats, trucks, or cars equipped with aerosol generators or from multiple fixed sites in a population-dense area. Delivery to sites 1 to 50 km upwind of large populations centers (e.g., the population corridor extending along the east coast from Washington, D.C., to Boston), could be devastating.

Aerosol or biological agents, if they enter the respiratory tract of a individual in sufficient amounts, present a high probability of an usually severe spectrum of the relevant disease and a very high mortality rate. To prevent wide spread casualties from an aerosol attack, it is imperative that access of aerosol particles (i.e., 1 to 5 microns) to the airway and conjunctivae of potential victims be markedly minimized.

Gas-type masks potentially offer protection from such aerosol bioattacks. To be effective, however, the masks must, in addition to filtering out or otherwise removing the biological agent, should be readily available, inexpensive, easy to use by essentially untrained personnel, present relatively small pressure gradients during breathing, easy to adapt to personnel of varying ages and/or sizes, lightweight, and comfortable to wear for prolonged periods of time (including periods of sleep). Unfortunately, currently available masks—generally of the military type—do not meet these requirements. Recently, U.S. Pat. No. 6,176,239 (Jan. 23, 2001), which is hereby incorporated by reference, provided an advanced chemical-biological mask. Although this mask represents a significant improvement relative to conventional military-type chemical-biological masks, it is expected to be too costly, complex, and uncomfortable for general civilian use in the case of a biological warfare attack. The present invention provides biological defense masks having the desired characteristics for general civilian population use.

Biological warfare aerosols are generally difficult to detect since they are usually invisible, odor-free, taste-free, and not detectable by condensation of liquid droplets. Thus, with only limited ability to detect a biological warfare aerosol attack, there is generally no signal to an at-risk population to implement the use of the biological defense masks (i.e., a mask-on signal). Likewise, in the event of an attack, there are no signals to indicate when it is safe to terminate the use of the biological defense masks (i.e., a mask-off signal). The present invention also provides methods, largely based on current and expected meteorological conditions downwind from, and within, the release area, to provide assistance in determining when and where to implement the use of the biological defense masks and when and where to terminate such use.

SUMMARY OF THE INVENTION

The invention relates to biological defense masks, and more particularly, biological defense masks designed for use by populations at risk of widespread attack from biological weapons of mass destruction, especially biological weapons involving aerosol attacks. The present invention is also related to methods for using such biological defense masks wherein meteorological data is used to issue advisories with regard to the use of such biological defense masks to a population at risk of exposure to biological weapons of mass destruction.

The present invention provides a biological defense mask covering at least the mouth, nasal passages, and eyes of a user, said biological defense mask comprising (1) a facepiece, wherein the facepiece can be attached to the user's head to cover the mouth, nasal passages, and eyes; (2) a sealing member attached to the facepiece to form a seal to the user's face and to form a breathing space around the mouth, nasal passages, and eyes; (3) at least one air filter inlet mounted on the facepiece and having a filtering element, whereby air from outside the facepiece, when the user inhales, can pass though the filtering element into the breathing space but air within the breathing space, when the user exhales, cannot pass through the filtering element in a reverse direction, wherein the filtering element can remove biological agent particles greater than about 0.3 microns in diameter from the air; (4) at least one exit passageway to provide communication between the breathing space and air outside the facepiece, whereby air, when the user exhales, can pass from the breathing space into air outside the facepiece, but cannot pass through the exit passageway in a reverse direction; and (5) a suspension system to attach the biological defense mask to the head of the user and to effect the seal to the user's face;

wherein the biological defense mask is lightweight, has a pressure gradient through the filtering element of less than about 15 mm water, and can be continuously worn comfortably by the user for at least 6 hours. Preferably, the pressure gradient through the filtering element is less than about 12 mm water and can be continuously worn comfortably by the user for at least 12 hours. If desired, the air filter inlet and the exit passageway may be combined into a single functional unit; any air passing into the breathing space must, of course, pass through the filtering element.

The present invention also provides a biological defense mask covering at least the mouth, nasal passages, and eyes of a user, said biological defense mask comprising (1) a facepiece, wherein the facepiece can be attached to the user's head to cover the mouth, nasal passages, and eyes, (2) a sealing member attached to the facepiece to form a seal to the user's face and to form a breathing space around the mouth, nasal passages, and eyes, (3) at least one air filter inlet mounted on the facepiece and having a filtering element, whereby air from outside the facepiece, when the user inhales, can pass though the filtering element into the breathing space, wherein the filtering element can remove biological agents greater than about 0.3 microns in diameter from the air; (4) at least one exit passageway to provide communication between the breathing space and air outside the facepiece, whereby air, when the user exhales, can pass from the breathing space into air outside the facepiece; and (5) a suspension system to attach the biological defense mask to the head of the user and to effect the seal to the user's face;

wherein the biological defense mask is lightweight, has a pressure gradient through the filtering element of less than about 15 mm water, and can be continuously worn comfortably by the user for at least 6 hours. Preferably, the pressure gradient through the filtering element is less than about 12 mm water and can be continuously worn comfortably by the user for at least 12 hours.

The present invention also provides a biological defense mask covering at least the mouth, nasal passages, and eyes of a user, said biological defense mask comprising (1) a facepiece, wherein the facepiece can be attached to the user's head to cover the mouth, nasal passages, and eyes of the user's face; (2) a sealing member attached to the facepiece to form a seal to the user's face and to form a breathing space around the mouth, nasal passages, and eyes; (3) at least two air filter inlets mounted on the facepiece and having at least two filtering elements, whereby air from outside the facepiece, when the user inhales, can pass though the filtering elements into the breathing space, wherein the filtering elements can remove biological agent particles greater than about 0.3 microns in diameter from the air, and wherein the two air filter inlets are located on either side and adjacent and in close proximity to the nasal passages; (4) at least one exit passageway to provide communication between the breathing space and air outside the facepiece, whereby air, when the user exhales, can pass from the breathing space into air outside the facepiece and wherein the at least one exit passageway is located in close proximity to the nasal passages and mouth; and (5) a suspension system to attach the biological defense mask to the head of the user and to effect the seal to the user's face;

wherein the facepiece closely conforms to the face of the user in order to reduce the breathing space, wherein the biological defense mask is lightweight, has a pressure gradient through the filtering element of less than about 12 mm water, has a protection factor greater than about 5000:1, and can be continuously worn comfortably by the user for at least 6 hours. Preferably, the pressure gradient through the filtering element is less than about 12 mm water and can be continuously worn comfortably by the user for at least 12 hours.

This invention also provides a method for protecting a population at risk of exposure to biological weapons of mass destruction containing biological agents, said method comprising:

(1) making biological defense masks and instructions for their use during a biological warfare attack available to the population;

(2) monitoring for biological warfare attack;

(3) in the event of attack or during periods of high risk of attack, evaluating current and predicted weather patterns in the geographic areas within, adjacent to, and downwind of, the biological warfare attack to determine likely distribution of significant amounts of the biological agents within the geographic areas;

(4) alerting the population and directing the use of the biological defense masks within the geographic areas of likely distribution of the biological agents;

(5) reevaluating, based on current and predicted weather patterns and data regarding actual distribution of the biological agents within the geographic areas, updated likely distribution of significant amounts of the biological agents within the geographic areas over time to provide updates;

(6) reporting the updates to the population with, as appropriate, instructions for continued use or termination of the use of the biological defense masks within the geographic areas of updated likely distribution of the biological agents or within new geographic areas of updated likely distribution of the biological agents; and (7) repeating steps (5) and (6) until no significant risk of exposure remains;

wherein the biological defense masks comprise (1) a facepiece, wherein the facepiece can be attached to the user's head to cover the mouth, nasal passages, and eyes; (2) a sealing member attached to the facepiece to form a seal to the user's face and to form a breathing space around the mouth, nasal passages, and eyes; (3) at least one air filter inlet mounted on the facepiece and having a filtering element, whereby air from outside the facepiece, when the user inhales, can pass though the filtering element into the breathing space, wherein the filtering element can remove biological agent particles greater than about 0.3 microns in diameter from the air; (4) at least one exit passageway to provide communication between the breathing space and air outside the facepiece, whereby air, when the user exhales, can pass from the breathing space into air outside the facepiece; and (5) a suspension system to attach the biological defense mask to the head of the user and to effect the seal to the user's face; wherein the biological defense mask is lightweight, has a pressure gradient through the filtering element of less than about 15 mm water, and can be continuously worn comfortably by the user for at least 6 hours. Preferably, the pressure gradient through the filtering element is less than about 12 mm water and can be continuously worn comfortably by the user for at least 12 hours. If desired, the air filter inlet and the exit passageway may be combined into a single functional unit or may be separate units; any air passing into the breathing space must, of course, pass through the filtering element.

DETAILED DESCRIPTION OF THE PREFERRED EMBODIMENTS

The invention relates to biological defense masks, and more particularly, biological defense masks designed for use by populations at risk of widespread biological attack via biological weapons of mass destruction, especially biological weapons involving aerosol attacks. The present invention is also related to methods for using such biological defense masks wherein meteorological data is used to issue advisories with regard to the use of such biological defense masks to a population at risk of exposure to biological weapons of mass destruction.

The biological defense mask of this invention is lightweight, has a pressure gradient through the filtering element of less than about 15 mm water, and can be continuously worn comfortably by the user for at least 6 hours. Preferably the pressure gradient through the filtering element is less than about 12 mm water and the mask can be continuously worn comfortably by the user for at least 12 hours. Preferably, the weight of the biological defense mask (not including any optional chemical absorbent canister) is less than about 14 ounces, and more preferably less than about 12 ounces. The biological defense mask of this invention is designed to be worn by civilian populations during a biological agent attack. As such, the biological warfare masks of this invention are designed to provide for comfortable respiration on the order of about 10 to about 15 liters/min. This respiration rate compares with about 85 l/min normally required for military type masks. Preferably the biological warfare masks of this invention can be worn for considerably longer periods, including periods of 12 hours or more. The biological defense masks of this invention can be manufactured in a variety of sizes to accommodate children and adults of various ages and sizes.

Figure 1:
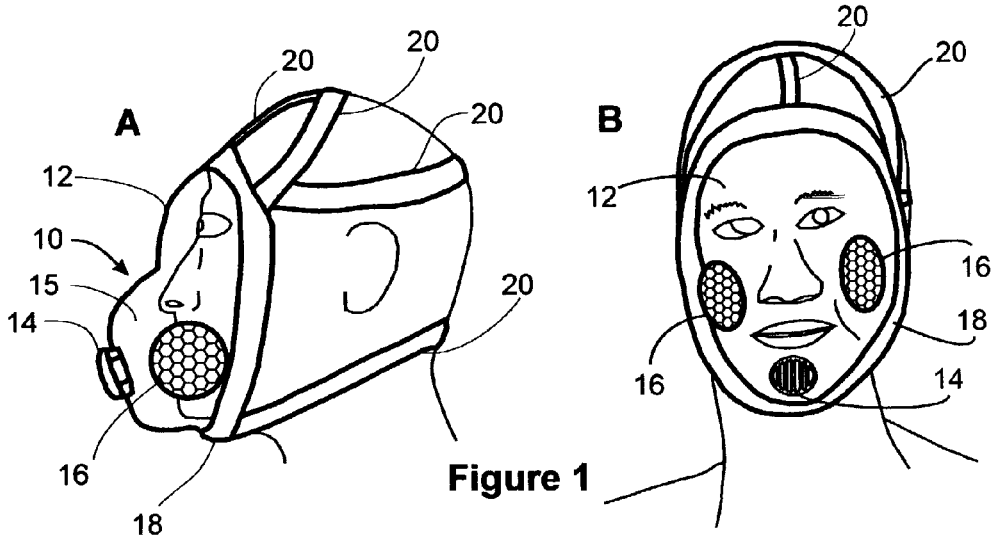
FIG. 1 illustrates a biological defense mask of the present invention having separate air filter inlets and a separate exit passageway. Panels A and B provide side and front views, respectively.
Figure 2:
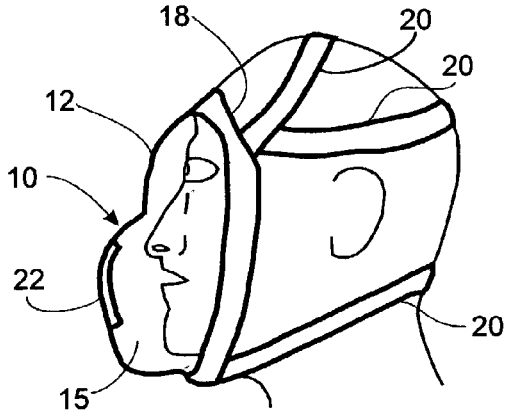
FIG. 2 illustrates another biological defense mask in side view of the present invention having integral air filter inlet and exit passageway.
Figure 3:
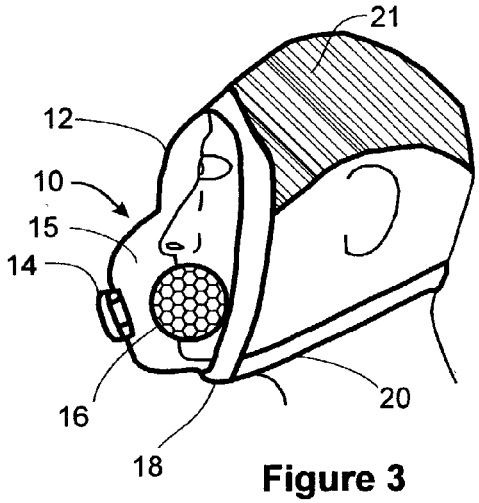
FIG. 3 illustrates a biological defense mask similar to FIG. 1 having a "skull cap" to secure the biological defense mask to the head of the users.
Figure 4:
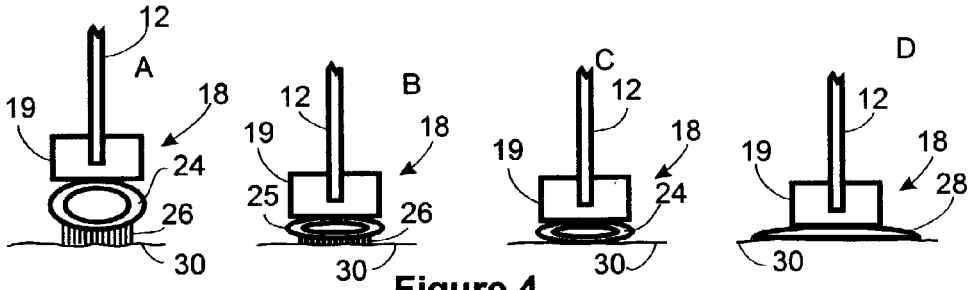
FIG. 4 illustrates several embodiments (Panels A through D) of suitable seals between the skin and the biological defense masks.
Figure 5:
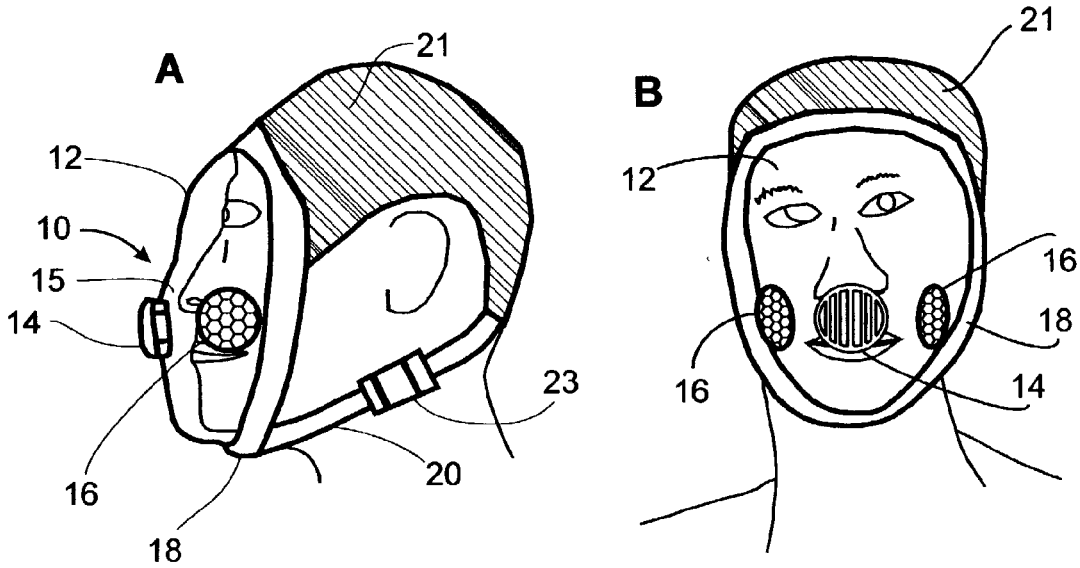
FIG. 5 illustrates an especially preferred biological defense mask having reduced dead space and reduced distance between the exit passageway and the nostrils and mouth. Panels A and B provide side and front views, respectively.
Figure 6:
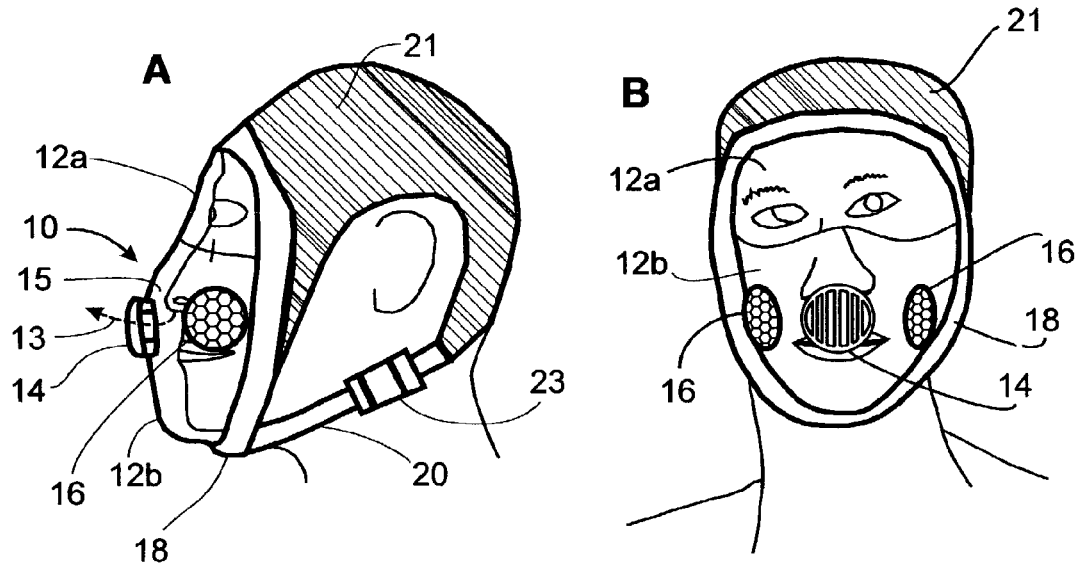
FIG. 6 illustrates another especially preferred biological defense mask having reduced dead space and reduced distance between the exit passageway and the nostrils and mouth. Panels A and B provide side and front views, respectively.
Figure 7:
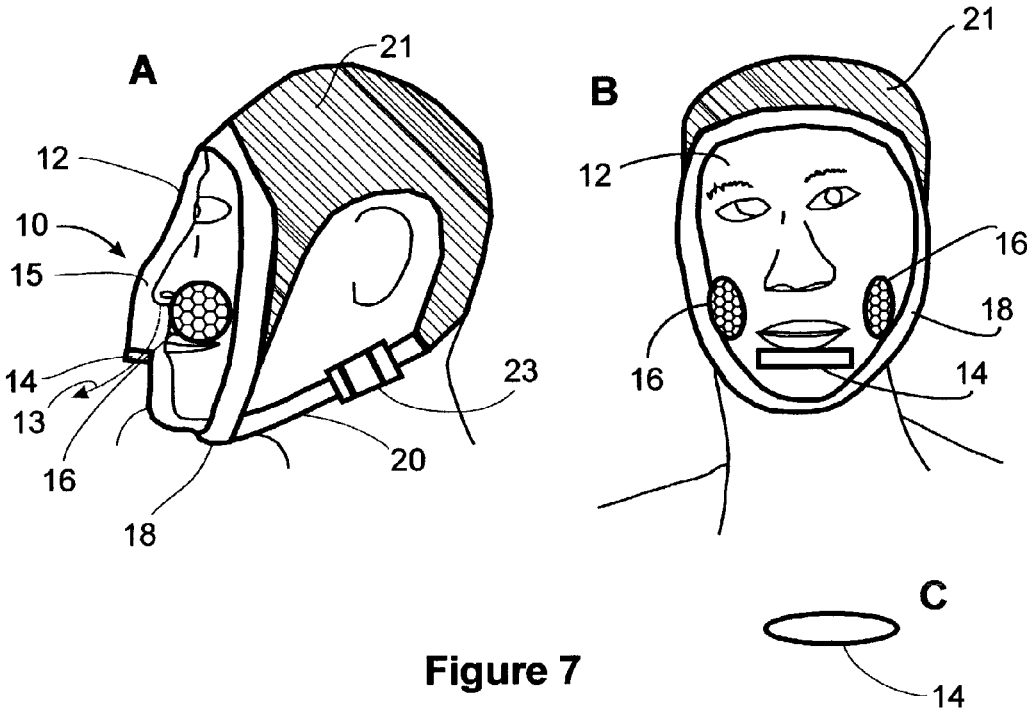
FIG. 7 illustrates another especially preferred biological defense mask having reduced dead space and reduced distance between the exit passageway and the nostrils and mouth wherein the export valve or port is positioned below the nostrils in such a manner to facilitate passage of air from the nostrils to outside the mask. Panels A and B provide side and front views, respectively; Panel C provides a cross-sectional view of the exhale valve or port as viewed from the ground.

Suitable biological defense masks 10 for use in the present invention are shown in FIGS. 1–3 with especially preferred embodiments shown in FIGS. 5–7. The biological defense mask 10 shown in FIG. 1 has a facepiece 12 with face frame/seal 18 (shown in various embodiments in FIG. 4), air filter inlet 16 mounted on the facepiece and having a filtering element, air exit passageway 14, and straps 20 for attaching the mask to the head of the user. The biological defense mask 10 shown in FIG. 2 has a facepiece 12 with face frame/seal 18 (shown in various embodiments in FIG. 4), combination air filter inlet and air exit passageway 22, and straps 20 for attaching the mask to the head of the user. The biological defense mask 10 shown in FIG. 3 has a facepiece 12 with face frame/seal 18 (shown in various embodiments in FIG. 4), air filter inlet 16 mounted on the facepiece and having a filtering element, air exit passageway 14, and skull cap 21 and strap 20 for attaching the mask to the head of the user.

The facepiece 12, when placed on the head of the user, defines a breathing space 15 containing at least the mouth, nasal passageways, and eyes of the user. Preferably, the breathing space is less than about 250 $cm^3$ and even more preferably less than about 200 $cm^3$. Although not shown, the biological warfare masks of the present invention can be modified to include a hood that covers the head; such hoods may be especially useful for individuals with facial hair and who, therefore, may have difficulty in achieving the desired seal between the mask and the skin.

Preferably, the air inlet 16 allows only air from the outside environment to pass into the breathing space 15; in other words, air inlet 16 only provides passage in one direction. Generally, air inlet 16 has a filtering medium which will not allow particles greater than about 0.3 microns to pass through. Suitable filtering mediums include, for example, high efficiency particulate air (HEPA) filters, ultra-low particle air (ULPA) filters, filters using an electrostatic material such as Advanced Electret Media (AEM; 3M, Minneapolis, Minn.) as described in U.S. Pat. Nos. 5,472,481, 5,350,620, and 5,411,576 (which are hereby incorporated by reference), and the like so long as they exclude particles having a diameter of greater than about 0.3 microns (and more preferably greater than about 0.2 microns) without exhibiting excess pressure gradients during use. Generally, HEPA filters are preferred. Moreover, HEPA filters having a filtering surface area of at least about 250 $cm^2$/filter are preferred; HEPA filters with a filtering surface area of at least about 300 $cm^2$/filter are even more preferred. Generally, it is preferred that two air inlets 16 are employed on either side of the faceshield 12 (see FIG. 1B). Thus, using the preferred number of HEPA filters having filtering surface areas of at least about 300 $cm^2$/filter, a combined filtering surface area of at least about 600 $cm^2$ is provided.

Although not shown in the figures, the biological defense masks of this invention may also have an optional chemical filter cartridge designed to attach to the air inlet 16 to provide protection against combined biological and chemical attacks or chemical only attacks. Such optional chemical filters could employ, for example, activated carbon absorbent or other chemical absorbents. The optional chemical filters are preferably designed to screw onto air inlet 16 such that air entering the breathing space 15 passes through both the chemical filter and the primary filtering media for biological agents.

Exit passageway 14 preferably only allows air to pass in one direction, namely from the breathing space 15 to the outside environment. Any suitable one-way flow valve can be used including, for example, flap valve, check valve, or the like.

A suspension system is used to attach the biological defense mask to the head of a users. One such suspension system uses straps 20 as shown in FIGS. 1 and 2; preferably the straps 20 are formed from an elastic material and have means (e.g., buckles, snaps, or other tighteners) to adjust the tightness of the fit and to accommodate different shaped heads. Of course other arrangements and number of adjustment straps 20 can be employed as desired. Another suspension system which consists of a skull cap 21 and an elastic strap 20 is shown in FIGS. 3 and 5. The skull cap 21 could extend further down the head (with or without ear holes) and even to cover the neck area to provide an even more secure fit (and, thus, avoid the need for strap 20). Such skull cap arrangements may be ideally suited for use in biological defense masks designed for small children and they would be more difficult for the child to remove. The use of skull caps, either of partial type shown in FIG. 3 or one providing more complete coverage of the head, could contribute to the comfort of the mask during extended usage. The skull cap can be made of an elastic material (e.g., lycra/spandex, nylon, or similar materials) which easily conforms to the shape of the skull and/or head; preferably the material is also breathable.

The facepiece 12 should be transparent at least in the area around the eyes; preferably the facepiece 12 is transparent throughout essentially its entire area to provide a panoramic vision field. As shown in the figures, the facepiece 12 can be spaced away from the face to provide breathing space 15. As shown in FIGS. 1–3, the facepiece 12 can be "ballooned" away from the nose and mouth areas; in such cases, the faceshield 12 in this "ballooned" area is generally distanced from the face by a distance of about 1.5 inches or more. Generally, the facepiece 12 is constructed of transparent polyurethane, polycarbonate, silicon rubber, and the like. The facepiece 12 may be rigid, semi-rigid, or flexible. Generally, a flexible facepiece 12 may incorporate stiffening members (not shown) to maintain the facepiece 12 in the desired position away from the face.

The facepiece 12 attaches to the face frame/seal 18 (i.e., the sealing member) as shown in FIG. 4. The face frame/seal combination 18 consists of a face frame 19 which extends around, and contacts, the face as shown in FIGS. 1–3 and 5–7 as well as sealing members to seal the biological warfare mask to the face. Several sealing mechanisms are shown in FIG. 4. The sealing mechanism of FIGS. 4A and 4B consists of a flexible rubber or silicone tube 24 attached to the inner surface of face frame 19. The tube 24 has ridges 26, preferably flexible, on its inner circumference which contact the skin 30. Panel A shows this face frame/seal combination 18 as it is placed on the face; panel B shows the same face frame/seal combination 18 after the mask has been secured in place to form the seal. The ridges 26 provide a plurality of seals to the face in order to minimize the possibility of leakage. In a preferred embodiment, the ridges 26 extend along and are parallel to the face frame 19 and number between about 5 to 20. In a more preferred embodiment, the ridges are about 0.2 to about 10 microns in height. FIG. 4C illustrates a similar sealing mechanism without such ridges. FIG. 4D illustrates a sealing mechanism having a flexible rubber or silicone seal 28 directly contacting skin 30. If desired, a non-irritating adhesive or sealant can also be applied to the sealing surface intended to contact the skin 30 before the mask is placed on the face. Generally, using the seals illustrated in FIG. 4, filtering efficiencies of greater than 99+ percent can be obtained.

Especially preferred biological warfare masks 10 are shown in FIGS. 5–7. The biological defense masks 10 shown in FIGS. 5–7 have essentially the same features as the masks shown in the previous figures but these features are configured in such a manner so as to provide better performance, ease of breathing, and comfort for the user. Increased comfort will, of course, increase the time a user can continuously wear the mask and increase the protection afforded by the mask. The facepiece 12 with face frame/seal 18 (shown in various embodiments in FIG. 4), air filter inlet 16 mounted on the facepiece and having a filtering element, air exit passageway 14, and straps 20 for attaching the mask to the head of the user have been modified to provide such increase efficiency and comfort. The facepiece 12 has been modified so as to reduce the breathing or dead space 15 which contains at least the mouth, nasal passageways, and eyes of the user. As shown in FIGS. 5–7, the facepiece 12 generally conforms to the shape of an average face so as to minimize the breathing space 15. The facepiece in FIG. 6 is divided into a transparent portion 12*a* (preferably polycarbonate) and an opaque portion 12*b* (preferably thermoplastic). The upper transparent portion 12*a* in FIG. 6 and the upper portion of facepiece 12 in FIG. 7 has been further fattened (relative to FIG. 5) in order to further reduce the volume of the breathing space 15. The materials of construction should be impervious to toxic chemical agents.

Preferably, the breathing space volume 15 is less than about 250 $cm^3$ and more preferably less than about 200 $cm^3$. Additionally, the air exit passageway 14 in FIGS. 5 and 6 has been moved to a position directly in front of the nostrils and mouth so as to minimize the distance between the nostrils and the air exit passageway 14. Generally, the air exit passageway 14 is located about 2 to about 2.5 cm anterior of the nostrils. Additionally, air filter inlets 16 have been moved to a position within about 2 to about 3 cm of the corresponding nostril. In FIG. 7, the air exit passageway 14 has been positioned directly below the nostrils such that exhaled air stream from the nostrils can pass almost directly out through the air exit passageway 14 (along the arrow 13) to help minimize $CO_2$ buildup within the breathing space 15. In this embodiment, the air exit passageway 14 is essentially parallel to the transverse plane containing the nostril openings. FIG. 7C shows the air exit passageway 14 viewed along the long axis of the body; the air exit passageway 14 is preferably located within about 2 to 3 cm below the nostrils. Preferably the air exit passageway 14 in FIG. 7 is elliptical in shape (generally about 2 to about 3 cm in minor diameter and about 6 to 10 cm in major diameter) and is a thin rubber, one-way, flap valve.

Figure 8:
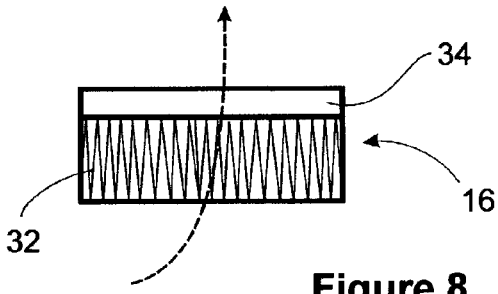
FIG. 8 illustrates a combined particle size filter and electrostatic filter for use in the biological defense masks of this invention.

Preferably, the air inlet 16 allows only air from the outside environment to pass into the breathing space 15; in other words, air inlet 16 only provides passage in one direction. Generally, air inlet 16 has a filtering medium which will not allow particles greater than about 0.3 microns to pass through. Suitable filtering mediums include, for example, HEPA filters, ultra-low particulate air (ULPA) filters, filters using an electrostatic material such as Advanced Electret Media (3M, Minneapolis, Minn.) as described in U.S. Pat. Nos. 5,472,481, 5,350,620, and 5,411,576 (which are hereby incorporated by reference), and the like so long as they exclude particles having a diameter of greater than about 0.3 microns (preferably greater than about 0.2 microns) without exhibiting excess pressure gradients during use. Even more preferably, the air inlet 16 uses a HEPA or ULPA filter combined with an electrostatic material filter to provide increased protection. Preferably, the protection factor (as measured by the ratio of particles 1 micron or greater outside and particles inside the mask during normal operation) is greater than about 5000:1 and is generally in the range of about 5000:1 to about 10,000:1. Preferably the air inlet 16 has an air resistance of about 10 to about 12 mm water or less and the air exit passageway 14 has an air resistance of about 5 to about 10 mm water or less. A preferred combination HEPA and electrostatic material filter 16 is shown in FIG. 8 having a pleated HEPA filter portion 32 and an electrostatic material filter portion 34. The dotted arrow in FIG. 8 shows the direction of passage of outside air through the combined filtering elements into the breathing space.

By minimizing the breathing space 15, locating the inlet and exit passageways adjacent and in close proximity to the nostrils, and providing low air resistance inlet and exit passageways, the buildup of $CO_2$ levels in the breathing space can be minimized. Preferably, $CO_2$ levels of less than about 1 percent can be obtained using the mask 10 as shown in FIGS. 5–7 during rest or minimal exertion.

To increase comfort and ease of use, and therefore increase the time the mask can be worn and overall compliance, the skull cap 21 has been modified to more completely cover the head. Attachment is through straps 20 located on either side of the head which can be tightened using buckle 23. Preferably, the skull cap 21 is made of an elastic material (e.g., lycra/spandex blend, nylon, or similar materials) which easily conforms to various shapes of the skull and/or head and is breathable.

As noted above, the present biological warfare masks are generally designed for civilian populations. It is expected that they will be used during a threatened or actual biological agent attack and that the civilian population will seek additional shelter (e.g., indoors with doors and windows shut to minimize exposure to the biological warfare agent). Under these conditions, heavy exertion is not to be expected so that fogging in the mask should not be a major problem, especially at the ambient temperatures normally expected in homes or other heated buildings where the civilian population will likely be. Nonetheless, an antifogging agent can be applied to the interior of the face shield 12 to further minimize fogging. Additionally, a soft nose cup or piece could be provided to direct exhaled air from the month and nose towards the exit passageway 14 to further reduce the risk of fogging; such a nose cup or piece should be easily attachable if its use is desired.

The biological warfare masks of this invention are ideally suited for use in a general method for protecting civilian populations. Moreover, the biological warfare masks of this invention are ideally suited for use in a method for protecting a population at risk of exposure to biological weapons of mass destruction containing biological agents, said method comprising: (1) making biological defense masks and instructions for their use during a biological warfare attack available to the population; (2) monitoring for biological warfare attack; (3) in the event of attack or during periods of high potential of attack, evaluating current and predicted weather patterns in the geographic areas within, adjacent to, and downwind of, the biological warfare attack to determine likely distribution of significant amounts of the biological agents within the geographic areas; (4) alerting the population and directing the use of the biological defense masks within the geographic areas of likely distribution of the biological agents; (5) reevaluating, based on current and predicted weather patterns and data regarding actual distribution of the biological agents within the geographic areas, updated likely distribution of significant amounts of the biological agents within the geographic areas over time to provide updates; (6) reporting the updates to the population with, as appropriate, instructions for continued use or termination of the use of the biological defense masks within the geographic areas of updated likely distribution of the biological agents or within new geographic areas of updated likely distribution of the biological agents; and (7) repeating steps (5) and (6) until no significant risk of exposure remains.

Figure 9:
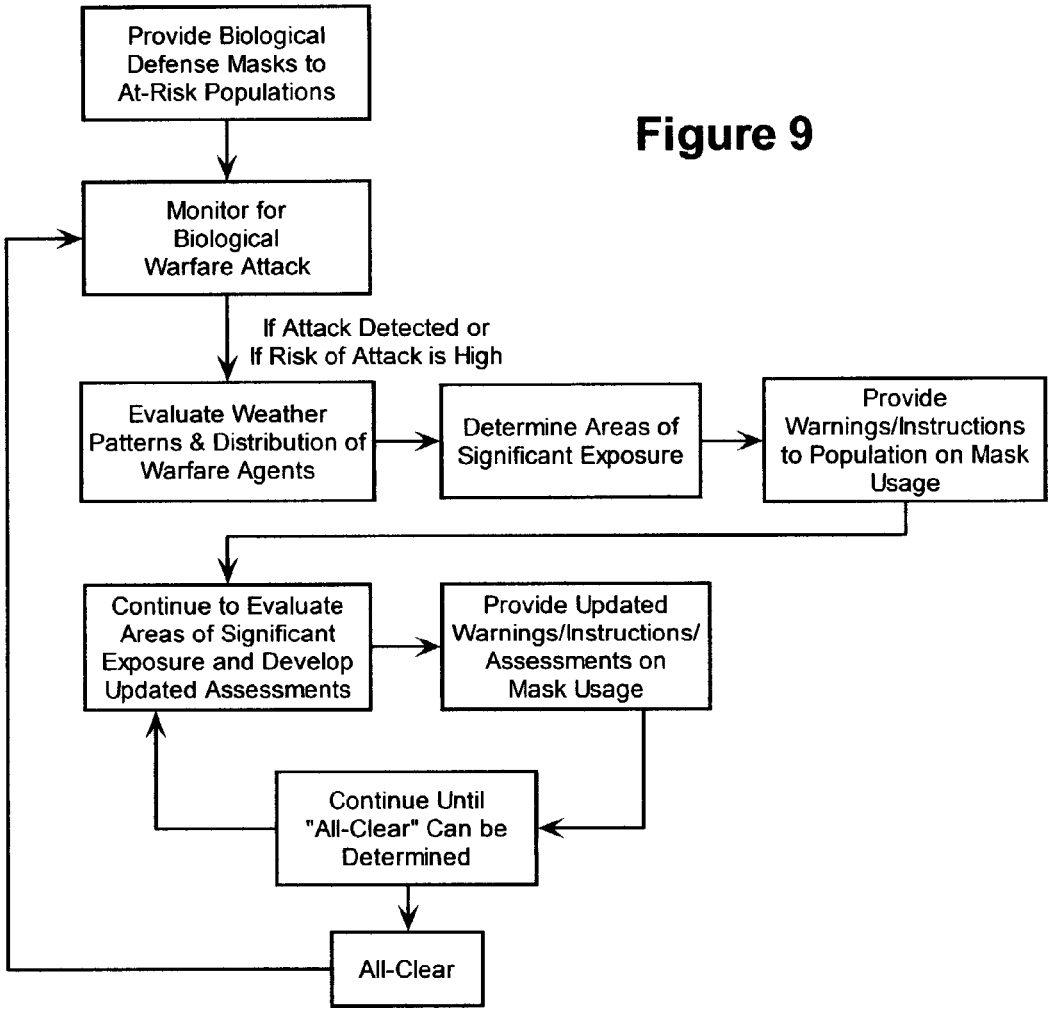
FIG. 9 provides a flowchart illustrating the general method of this invention.

FIG. 9 provides a general flowchart illustrating a method of protecting civilian populations using the biological warfare masks of this invention. This method involves making the biological defense masks available to an at-risk population. Although any population may be considered at-risk of a terrorist attack, large population centers (i.e., major cities) are more likely to be targeted. The masks may be distributed by local, state, or national governments or may be made available to the general public through retail outlets. The method also involves monitoring (preferably continuous monitoring) for such biological warfare attack. Once such an attack is detected or if the risk of such attack is high, weather conditions and patterns in the vicinity of the target area are to be evaluated in order to determine the likely geographic distribution of biological agents from such an attack and the areas of potentially significant exposure. Especially important weather conditions to be considered are temperature inversions and wind conditions (especially conditions involving low or no winds). Temperature inversions and low ground wind speeds will tend to keep the biological warfare agent cloud intact, close to the ground, and delay its dispersion, thereby increasing the risk of exposure to the population in the area. On the other hand, high wind speed and the absence of temperature inversions will tend to disperse the biological warfare agent cloud and reduce the risk of significant exposure.

Once the areas of potentially significant exposure have been determined, instructions and warnings to the affected population should be issued. Such instructions, which can be issued through local TV and radio outlets, local emergency broadcast or other warning systems, National Oceanic and Atmospheric Administration (NOAA) weather radio, should include directions on when and how to use the masks as well as other information (e.g., instructions to stay indoors, seal windows and doors, protect food and water supplies from contact with outside air, and the like). Evaluation should continue to provide updated assessments for the areas at risk in the initial attack as well as to issue new warnings to other areas that may be later threatened by the attack (or other attacks that may follow). The continued evaluation can also incorporate data from measurements of actual exposure to the biological warfare agent (in addition to data regarding actual and expected weather conditions). Actual exposure data could be generated, for example, by analyzing the filters of the biological warfare masks using specific biochemical or biological tests (e.g., PCR and the like) as well as fixed air sampling equipment or filters located within the potential exposure area. Generally, mask usage should continue until an "all-clear" message is issued. Such an "all-clear" message can generally be issued about 1 to 2 hours after the temperature inversion has lifted, the wind speed increased significantly, or actual biochemical exposure data indicates the threat has passed.

As noted, in the event of such an attack and exposure, samples could be taken from a representative number of biological defense masks to determine actual exposure levels with regard to both the actual agents used in the attack and the level and geographic distribution of the agents. This information could be used immediately to determine appropriate medical treatment of exposed persons (i.e., individuals who did not use the biological warfare masks of the present invention for all or part of the exposure period) in order to reduce the effects of the biological agents. This information could also be compared to the predicted distribution patterns based on weather predictions in order to improve the modeling used in making the initial exposure areas and patterns.

We claim:

1. A method for protecting a population at risk of exposure to biological weapons of mass destruction containing biological agents, said method comprising:

(1) making biological defense masks and instructions for their use during a biological warfare attack available to the population;

(2) monitoring for biological warfare attack;

(3) in the event of attack or during periods of high risk of attack, evaluating current and predicted weather patterns in the geographic areas within, adjacent to, and downwind of, the biological warfare attack to determine likely distribution of significant amounts of the biological agents within the geographic areas;

(4) alerting the population and directing the use of the biological defense masks within the geographic areas of likely distribution of the biological agents;

(5) reevaluating, based on current and predicted weather patterns and data regarding actual distribution of the biological agents within the geographic areas, updated likely distribution of significant amounts of the biological agents within the geographic areas over time to provide updates;

(6) reporting the updates to the population with, as appropriate, instructions for continued use or termination of the use of the biological defense masks within the geographic areas of updated likely distribution of the biological agents or within new geographic areas of updated likely distribution of the biological agents; and (7) repeating steps (5) and (6) until no significant risk of exposure remains;

wherein each of the biological defense masks comprises (1) a facepiece, wherein the facepiece can be attached to the user's head to cover the mouth, nasal passages, and eyes, (2) a sealing member attached to the facepiece to form a seal to the user's face and to form a breathing space around the mouth, nasal passages, and eyes, (3) at least one air filter inlet mounted on the facepiece and having a filtering element, whereby air from outside the facepiece, when the user inhales, can pass though the filtering element into the breathing space, wherein the filtering element can remove biological agents greater than about 0.3 microns in diameter from the air; (4) at least one exit passageway to provide communication between the breathing space and air outside the facepiece, whereby air, when the user exhales, can pass from the breathing space into air outside the facepiece; and (5) a suspension system to attach the biological defense mask to the head of the user and to effect the seal to the user's face; wherein the biological defense mask is lightweight, has a pressure gradient through the filtering element of less than about 15 mm water, and can be continuously worn comfortably by the user for at least 6 hours.

2. The method as defined in claim 1, wherein the air filter inlet and the exit passageway are combined into a single functional unit.

3. The method as defined in claim 2, wherein each of the biological defense masks weighs less than about 12 ounces.

4. The method as defined in claim 1, wherein the filtering element is a HEPA filter, a filter containing an electrostatic material, or a combination HEPA and electrostatic material filter.

5. The method as defined in claim 1, wherein each of the biological defense masks weighs less than about 12 ounces.

6. The method as defined in claim 1, wherein facepiece in contact with the breathing space is formed with an anti-fogging agent.

7. The method as defined in claim 1, further comprising a chemical filter which can be attached to the at least one air filter inlet by the user to provide further protection in the case of a chemical attack.

* * * * *